US008752529B2

(12) United States Patent
Basaki et al.

(10) Patent No.: US 8,752,529 B2
(45) Date of Patent: Jun. 17, 2014

(54) SPARK IGNITION INTERNAL COMBUSTION ENGINE

(75) Inventors: Masatoshi Basaki, Nukata-gun (JP); Tomohiro Hayashi, Okazaki (JP); Takeshi Mizobuchi, Obu (JP)

(73) Assignee: Denso Corporation, Kariya (JP)

( * ) Notice: Subject to any disclaimer, the term of this patent is extended or adjusted under 35 U.S.C. 154(b) by 236 days.

(21) Appl. No.: 13/290,410

(22) Filed: Nov. 7, 2011

(65) Prior Publication Data

US 2012/0111301 A1 May 10, 2012

(30) Foreign Application Priority Data

Nov. 8, 2010 (JP) ..... 2010-249733

(51) Int. Cl.
*F02D 41/32* (2006.01)
*F02D 41/30* (2006.01)

(52) U.S. Cl.
USPC ..... 123/478; 123/575; 701/105

(58) Field of Classification Search
USPC ..... 123/295, 305, 472, 475, 476, 478, 575; 701/101, 102, 103, 105
See application file for complete search history.

(56) References Cited

U.S. PATENT DOCUMENTS

2010/0012081 A1* 1/2010 Ashizawa ..... 123/301

FOREIGN PATENT DOCUMENTS

| | | | | |
|---|---|---|---|---|
| JP | 03054332 A | * | 3/1991 | ..... F02D 41/02 |
| JP | 9-222045 | | 8/1997 | |
| JP | 11-013583 | | 1/1999 | |
| JP | 2002-070624 | | 3/2002 | |
| JP | 2006-002698 | | 1/2006 | |
| JP | 2008-196318 | | 8/2008 | |
| JP | 2008-223676 | | 9/2008 | |
| JP | 2008298046 A | * | 12/2008 | |
| JP | 2009-138608 | | 6/2009 | |
| JP | 2009-138665 | | 6/2009 | |
| JP | 2009-191702 | | 8/2009 | |
| JP | 2009-203814 | | 9/2009 | |
| JP | 2009203813 A | * | 9/2009 | |
| JP | 2010-024860 | | 2/2010 | |

OTHER PUBLICATIONS

Office Action (2 pages) dated Aug. 20, 2013, issued in corresponding Japanese Application No. 2010-249733 and English translation (3 pages).
Office Action (2 pages) dated Nov. 12, 2013, issued in corresponding Japanese Application No. 2010-249733 and English translation (2 pages).

* cited by examiner

*Primary Examiner* — Mahmoud Gimie
(74) *Attorney, Agent, or Firm* — Nixon & Vanderhye PC

(57) ABSTRACT

A spark ignition internal combustion engine is equipped with a fuel pressure sensor for detecting a viscosity of fuel supplied to a fuel injector based on a variation in a fuel pressure. In a case of stratified combustion by a spray guided injection, an ECU advances a fuel injection start timing of the fuel injector 4 according to the detected viscosity of the fuel. Thus, even if the viscosity of the fuel is significantly high, the fuel-rich area is well formed at a vicinity of the discharge electrode so that a preferable combustion condition can be maintained.

7 Claims, 10 Drawing Sheets

SPARK IGNITION INTERNAL COMBUSTION ENGINE

CROSS-REFERENCE TO RELATED APPLICATION

This application is based on Japanese Patent Application No. 2010-249733 filed on Nov. 8, 2010, the disclosure of which is incorporated herein by reference.

FIELD OF THE INVENTION

The present invention relates to a spark ignition internal combustion engine in which air-fuel mixture starts to be combusted by spark generated by a spark plug.

BACKGROUND OF THE INVENTION

JP-2008-196318A shows a spark ignition internal combustion engine in which gasoline containing alcohol, such as ethanol, is combusted. Especially, JP-2008-196318A shows a technology in which a stratified combustion is stably conducted.

As the quantity of alcohol contained in gasoline increases, a fuel injection time period is more prolonged, whereby the stratified combustion is deteriorated. An engine control system shown in JP-2008-196318A is provided with an alcohol sensor detecting alcohol concentration in fuel. When the alcohol concentration is increased, a spray-guided fuel injection is switched into a wall-guided fuel injection so that the stratified combustion is well conducted.

However, in this engine control system, the viscosity of the fuel is not considered, although the viscosity of the fuel is not constant.

(i) For example, the viscosity of gasoline depends on the temperature thereof. As the temperature is decreased, the viscosity increases. That is, even if the fuel is gasoline including no alcohol, the viscosity of the fuel increases in cold climates.

(ii) In a case the fuel is gasoline including alcohol, since the viscosity of alcohol is greater than that of gasoline, the viscosity of the fuel increases along with an increase in contained alcohol.

When the viscosity of the fuel is varied, the shape of fuel spray injected from a fuel injector is also varied. Specifically, when the viscosity of the fuel is relatively small, for example, the viscosity of gasoline at ordinary temperature, the fuel spray injected from a fuel injector is spread as shown by a long dashed short dashed line $\alpha$ in FIG. 4A. As the viscosity of the fuel increases, the fuel spray is narrowed as shown by a solid line $\beta$ in FIG. 4A.

As above, the shape of the fuel spray is varied according to a variation in fuel viscosity and the distance between a discharge portion of a spark plug and the fuel spray is also varied. However, in a conventional engine control system, since the viscosity of the fuel is not considered, the fuel combustion condition may be deteriorated due to a variation in fuel viscosity.

SUMMARY OF THE INVENTION

The present invention is made in view of the above matters, and it is an object of the present invention to provide a spark ignition internal combustion engine which is able to restrict a deterioration in combustion condition even if a viscosity of fuel is varied.

According to the present invention, a spark ignition internal combustion engine has a controller which varies at least one of a fuel injection timing and a fuel injection pattern of the fuel injector according to a viscosity of fuel detected by a fuel viscosity detector.

According to another aspect of the invention, the controller advances the fuel injection timing of the fuel injector according to the detected viscosity of the fuel when it is determined that the detected viscosity of the fuel is higher than a viscosity of gasoline at normal temperature.

According to another aspect of the invention, the controller advances the fuel injection timing of the fuel injector and performs a split injection according to the detected viscosity of the fuel when it is determined that the detected viscosity of the fuel is higher than a viscosity of gasoline at normal temperature.

According to another aspect of the invention, the spark ignition internal combustion engine has a vortex generating portion which generates a vortex flow of the fuel in the cylinder and a controller which controls the vortex generating portion in such a manner that an intensity of the vortex flow of the fuel is varied according to the viscosity of the fuel detected by the fuel viscosity detector.

According to another aspect of the invention, the controller controls the vortex generating portion so that the intensity of the vortex flow is increased when it is determined that the detected viscosity of the fuel is higher than a viscosity of gasoline at normal temperature.

According to another aspect of the invention, the fuel pressure sensor detects the viscosity of the fuel based on a variation in fuel pressure that is caused due to an operation of the fuel injector.

According to the other aspect of the invention, the fuel viscosity detector detects the viscosity of the fuel based on a displacement rate of a needle valve of the fuel injector.

BRIEF DESCRIPTION OF THE DRAWINGS

Other objects, features and advantages of the present invention will become more apparent from the following description made with reference to the accompanying drawings, in which like parts are designated by like reference numbers and in which.

DETAILED DESCRIPTION OF EMBODIMENTS

[First Embodiment]

Figure 1:
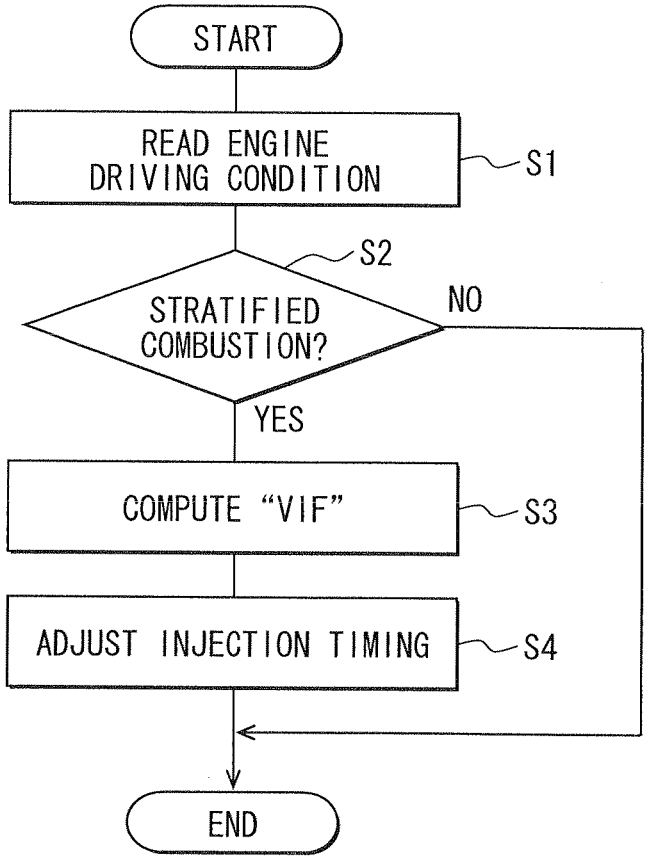
FIG. 1 is a flowchart showing a fuel injection control according to a viscosity of fuel according to a first embodiment.
Figure 2:
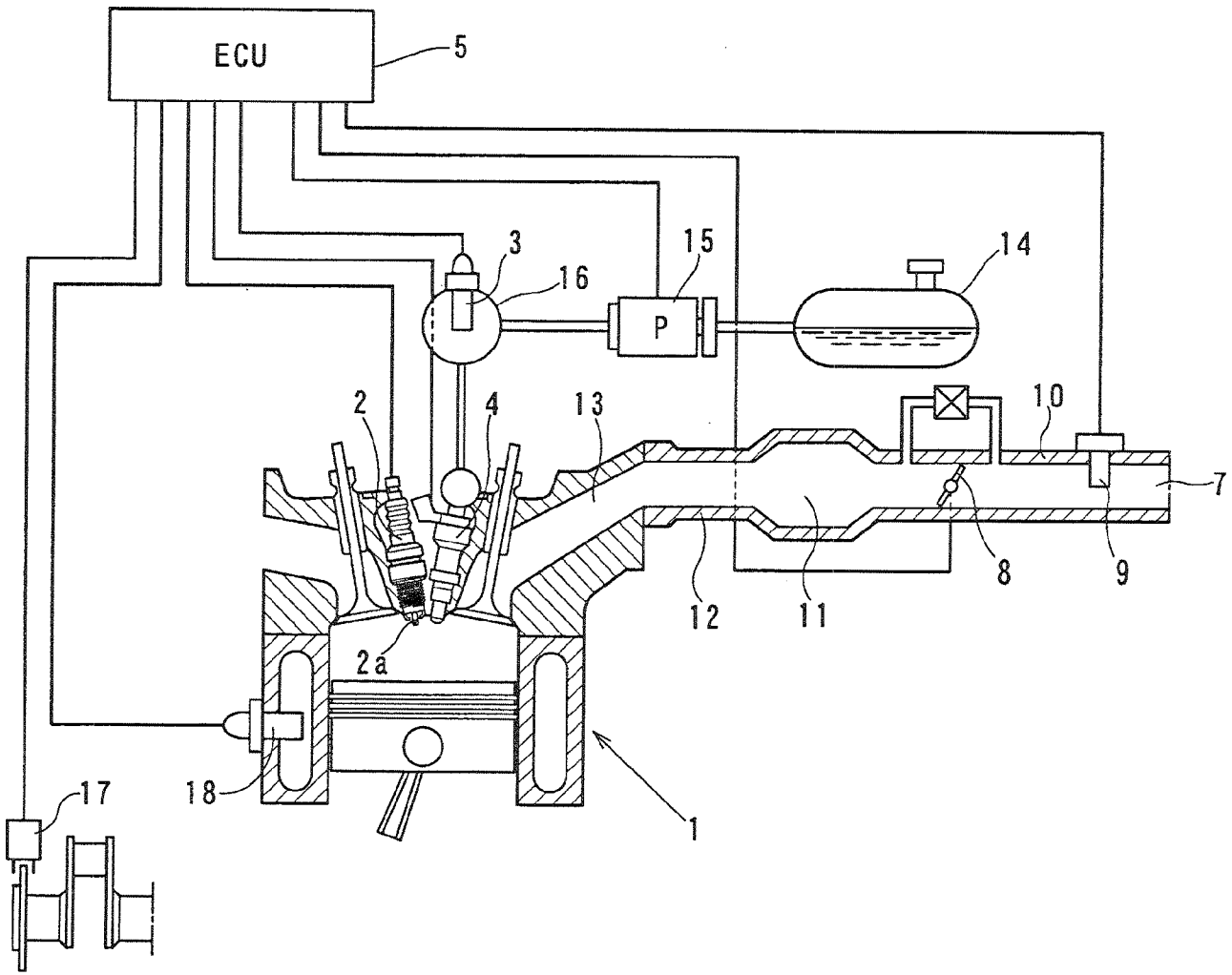
FIG. 2 is a schematic view showing a spark ignition internal combustion engine according to the first embodiment.

Referring to FIGS. 1 to 6, a first embodiment of the present invention will be described. As shown in FIG. 2, an internal combustion engine 1 is provided with a spark plug 2 of which discharge electrode 2*a* is arranged in a cylinder, and a fuel injector 4 which directly injects fuel into the cylinder. An electronic control unit (ECU) 5 executes an engine control in which a fuel injection timing and an ignition timing are controlled.

When an engine load is relatively large, a homogeneous combustion is conducted. When the engine load is relatively small, a stratified combustion is conducted. The stratified combustion is well known lean combustion in which a combustion chamber is divided into a fuel-rich area and an air-rich area. An ignition is conducted in the fuel-rich area.

The engine 1 is provided with an intake passage 7 and an exhaust passage (not shown). The intake passage 7 is defined by an intake pipe 10 in which a throttle valve 8 and an airflow meter 9 are provided, an intake manifold 12 having a surge tank 11, and an intake port 13 provided on a cylinder head of the engine 1.

Figure 3:
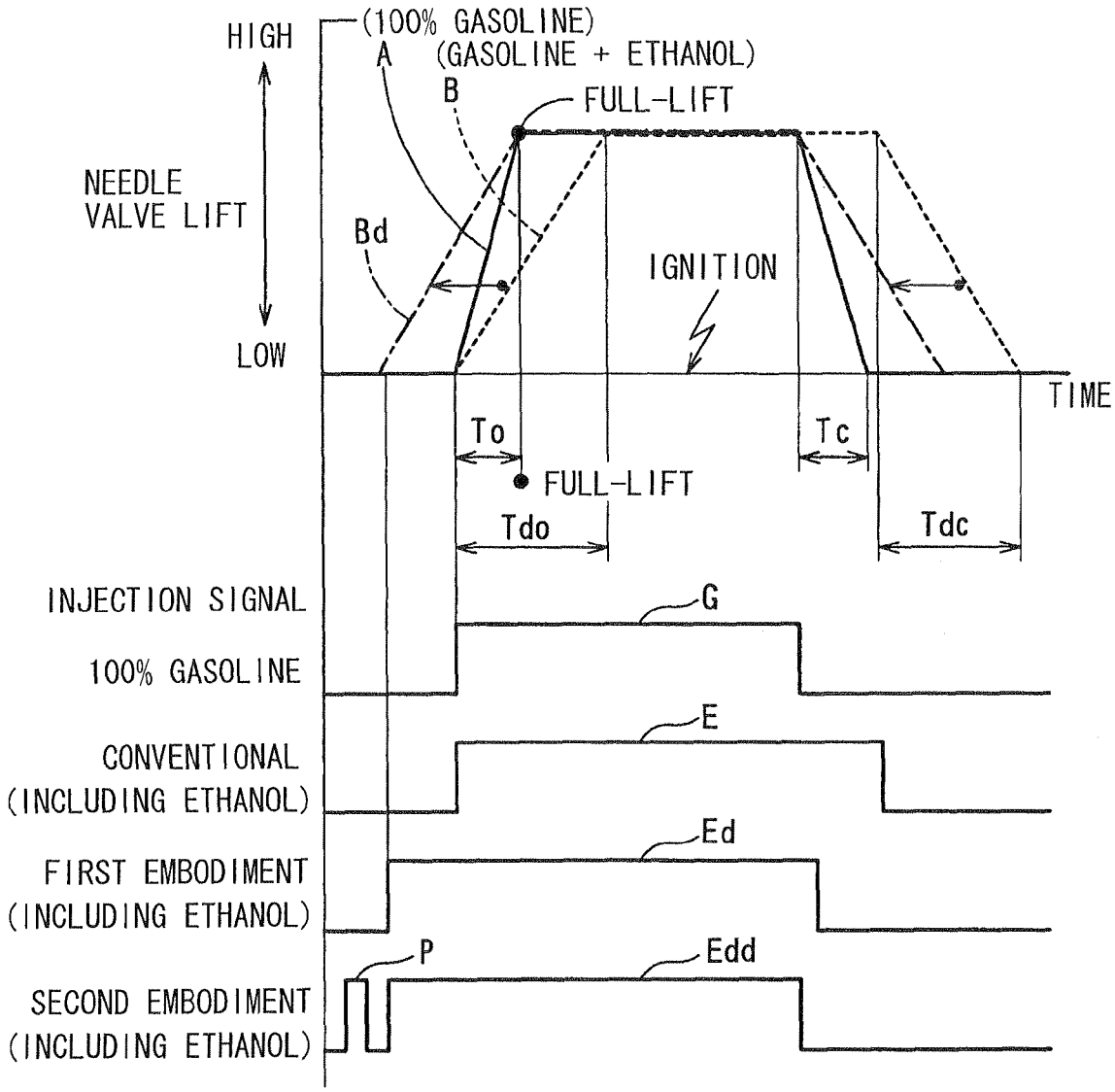
FIG. 3 is a time chart showing a relationship between a fuel injection signal and a needle valve lift amount.

The fuel injector 4 has a well known configuration. Specifically, the fuel injector 4 has a needle valve therein. As shown in FIG. 3, when the fuel injector 4 receives an injection signal from the ECU 5, the needle valve is lifted up to stat injecting the fuel through an injection port. A maximum lift amount of the needle is regulated by a full-lift position. When the fuel injector 4 receives no injection signal from the ECU 5, the needle valve is lifted down to terminate the fuel injection.

The fuel injector 4 is provided on an engine 1 in such a manner as to inject the fuel toward a vicinity of the discharge electrode 2*a* of the spark plug 2 in a case of spray-guided fuel injection. It should be noted that the fuel injected from the fuel injector 4 becomes atomizing fuel in a cylinder.

As described above, it is likely that the fuel is gasoline containing alcohol (ethanol). Since the viscosity of the alcohol is greater than that of gasoline, the viscosity of the fuel depends on the contained quantity of alcohol. The viscosity of the fuel is referred to as "VIF" hereinafter.

Figure 5A:
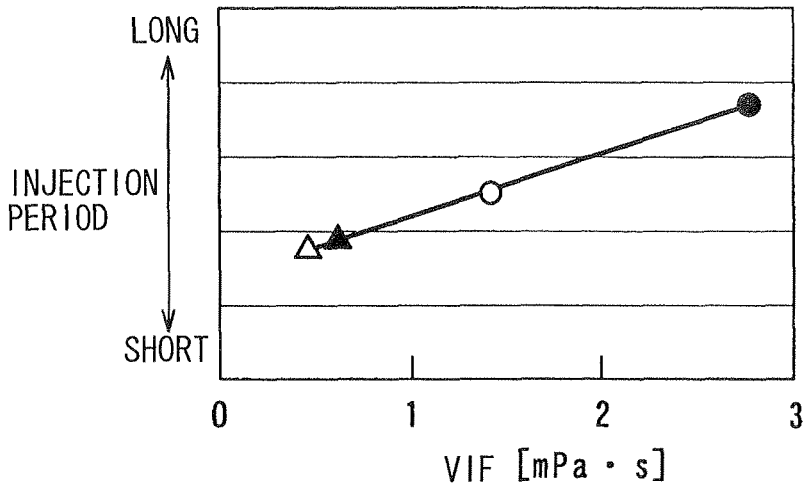
FIG. 5A is a graph showing a relationship between a viscosity of fuel and a fuel injection period.
Figure 5B:
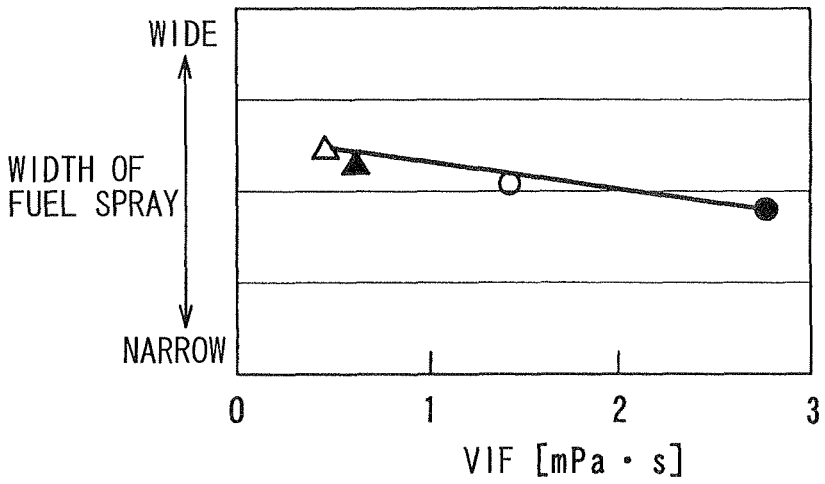
FIG. 5B is a graph showing a relationship between a viscosity of fuel and a width of fuel spray.
Figure 6:
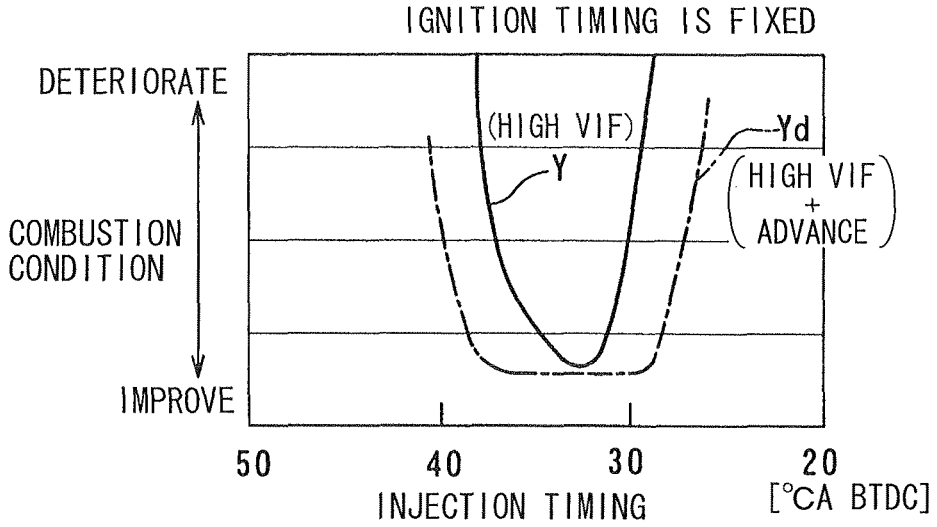
FIG. 6 is a graph showing a relationship between a fuel injection timing and a variation in combustion condition according to the first embodiment.

Referring to FIGS. 5A and 5B, an injection characteristic of the fuel injector 4 relative to a variation in the VIF will be described, hereinafter.

In a case that the injection signal is transmitted to the fuel injector 4 at regular time intervals, as the VIF is more increased, the actual fuel injection period in which the injection port is opened is more prolonged as shown in FIG. 5A. Because a moving resistance or a sliding resistance of the needle valve of the fuel injector 4 becomes larger, the actual fuel injection period is prolonged.

In a case that the injection signal is transmitted to the fuel injector 4 at regular time intervals, as the VIF is more increased, the width of the fuel spray becomes narrower as shown in FIG. 5B. Because the fuel is hardly spread due to an increase in the VIF, the fuel spray becomes narrower. That is, when the VIF is relatively low, the fuel spray is spread as shown by a long dashed short dashed line $\alpha$ in FIG. 4A. Meanwhile, when the VIF is relatively large, the fuel spray is narrowed as shown by a solid line $\beta$ in FIG. 4A.

In a spray-guided fuel injection, a distance between the discharge electrode 2*a* of the spark plug 2 and the injected fuel spray has significance in order to achieve a stable stratified combustion. This distance is designed optimum for a case of the stratified combustion of 100% gasoline by the spray-guided fuel injection. However, when the VIF becomes higher along with the concentration of alcohol, the distance between discharge electrode 2*a* and the fuel spray becomes longer. Thus, as shown in FIG. 4B, a stable combustion range is narrowed.

Figure 4A:
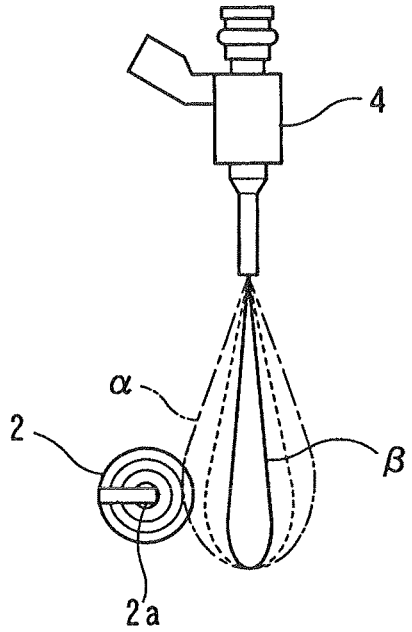
FIG. 4A is a view for explaining a distance between a discharge electrode and a fuel spray.
Figure 4B:
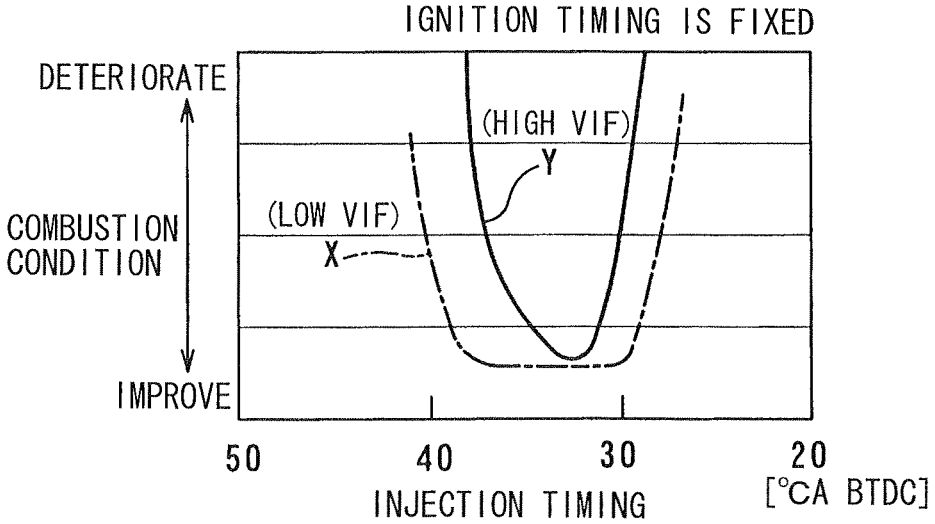
FIG. 4B is a graph showing a variation in fuel injection timing and a variation in combustion condition.

Specifically, a long dashed short dashed line "X" in FIG. 4B shows a relationship between a fuel injection timing [° CA BTDC] and a combustion condition in a case of a low VIF. The fuel spray is spread, so that a favorable combustion condition can be obtained in a wide range of the fuel injection timing. Meanwhile, a solid line "Y" of FIG. 4B shows a relationship between a fuel injection timing [°CA BTDC] and a combustion condition in a case of a high VIF. The fuel spray is narrowed, so that a favorable combustion condition can be obtained only in a narrow range of the fuel injection timing. That is, the stable combustion range is narrow and a combustion condition may be deteriorated.

If the VIF is varied, the following control will be executed.

Referring to FIG. 3, a control of the fuel injector 4 will be described. It should be noted that a case where the fuel is 100% gasoline is referred to as a case where the VIF is low, and a case where the fuel is gasoline containing ethanol is referred to as a case where the VIE is high. The viscosity of gasoline containing ethanol is higher than that of 100% gasoline.

Referring to FIG. 3, a variation in lift amount of the needle valve of when the ECU 5 transmits the injection signal to the fuel injector 4 will be described.

In FIG. 3, a solid line "G" indicates an injection signal in a case of 100% gasoline, a solid line "E" indicates an injection signal in a case of gasoline containing ethanol according to conventional art, and a solid line "Ed" indicates an injection signal in a case of gasoline containing ethanol according to the first embodiment.

Further, a solid line "A" indicates a variation in needle valve lift amount in a case of 100% gasoline, a solid line "B" indicates a variation in needle valve lift amount in a case of gasoline containing ethanol according to conventional art, and a solid line "Bd" indicates a variation in needle valve lift amount in a case of gasoline containing ethanol according to the first embodiment.

A lift-up period from when the ECU 5 transmits the injection signal to the fuel injector 4 until when the needle valve is fully lifted up is denoted by "To" in a case of 100% gasoline. And the lift-up period is denoted by "Tdo" in a case of gasoline containing ethanol. It is apparent that the period "Tdo" is longer than the period "Td".

Further, a lift-down period from when the ECU 5 terminates the transmission of the injection signal to the fuel injector 4 until when the needle valve is seated is denoted by "Tc" in a case of 100% gasoline. And the lift-down period is denoted by "Tdc" in a case of gasoline containing ethanol. It is apparent that the period "Tdc" is longer than the period "Tc".

As above, it can be understood that the actual fuel injection period is varied according to a variation in the VIF.

If the lift-up period "Tdo" is prolonged due to an increase in the VIF, the fuel injection quantity during this period "Tdo" is decreased and the fuel injection pressure is hardly increased. Thus, the fuel spray injected during this period "Tdo" is deteriorated in its atomization and the fuel becomes lean. That is, during the period "Tdo", the fuel-rich area is not well formed at a vicinity of the discharge electrode 2*a*.

According to the first embodiment, in a case of gasoline containing ethanol, as shown by a solid line "Ed" in FIG. 3, a fuel injection start timing and the lift-up period "Tdo" are advanced, whereby the fuel-rich area is well formed at a vicinity of the discharge electrode 2*a* to improve the stratification of fuel.

Specifically, according to the first embodiment, a fuel injection start timing of the fuel injector 4 is advanced according to a rise in the VIF. According to a conventional art, if the VIF is high, the stable combustion range [° CA BTDC] is narrow as shown by a solid line "Y" in FIG. 6. Meanwhile, in the first embodiment, even if the VIE is high, the fuel injection start timing [° CA BTDC] of the fuel injector 4 is advanced, whereby the stable combustion range is expanded as shown by a long dashed short dashed line "Yd" in FIG. 6.

A specific configuration of the first embodiment will be described hereinafter.

A fuel pressure sensor 3 detects the viscosity of the fuel (VIE) which is supplied to the fuel injector 4. The fuel pressure sensor functions as a fuel viscosity detector. The ECU 5 advances the fuel injection start timing of the fuel injector 4 according to the VIF detected by means of the fuel pressure sensor 3. The fuel pressure sensor 3 detects the VIF based on a variation in fuel pressure that is caused due to an operation of the fuel injector 4.

The engine 1 is equipped with a fuel injection system including the fuel injector 4. The fuel injection system further includes a high-pressure fuel pump 15 which pumps up the fuel in a fuel tank 14, and an accumulator (common-rail) 16 which accumulates the pressurized fuel therein. The fuel accumulated in the accumulator 16 is supplied to the fuel injector 4. The fuel pressure sensor 3 is attached to the accumulator 16 to continuously detect the variation in fuel pressure in the accumulator 16. The output of the fuel pressure sensor 3 is transmitted into the ECU 5, and the ECU 5 computes the VIF according to the variation in fuel pressure.

When the ECU 5 determines that the computed VIF is higher than the viscosity of gasoline at normal temperature, the ECU 5 advances the fuel injection timing of the fuel injector 4 according to the computed VIF. The advance amount of the fuel injection timing is obtained by means of a map or a formula previously stored in the ECU 5.

It should be noted that the ECU 5 includes a microcomputer comprised of a CPU, a memory, an input circuit, and an output circuit. The ECU 5 receives output signals from various sensors, such as the fuel pressure sensor 3, the airflow meter 9, an accelerator position sensor (not shown), an engine speed sensor (not shown), an crank angle sensor 17, and an engine coolant temperature sensor 18.

Referring to FIG. 1, the injection timing control which the ECU 5 executes according to the VIF will be described hereinafter.

In step S1, the ECU 5 reads an engine driving condition, such as the engine coolant temperature, the engine speed and the engine load.

In step S2, the ECU 5 determines whether a fuel combustion condition is the stratified combustion. When the answer is NO (homogeneous combustion) in step S2, the procedure ends.

When the answer is YES in step S2, the procedure proceeds to step S3 in which the VIF is computed based on the output of the fuel pressure sensor 3. Then, the procedure proceeds to step S4 in which the injection timing is adjusted according to the VIF. Specifically, when it is determined that the computed VIF is higher than the viscosity of gasoline at normal temperature, the fuel injection start timing and the fuel injection end timing are advanced according to the VIF. Then, this procedure ends.

(Advantage of First Embodiment)

As described above, the fuel injection start timing of the fuel injector 4 is varied according to the VIF detected by means of the fuel pressure sensor 3. Specifically, when it is determined that the computed VIF is higher than the viscosity of gasoline at normal temperature, the fuel injection start timing of the fuel injector 4 is advanced according to the VIF.

Thus, even if the VIF is significantly high, the fuel injection start timing is advanced so that the air-fuel mixture is well formed at a vicinity of the discharge electrode 2*a*. That is, by the time when the spark plug 2 discharges, the fuel spray is well spread so that combustion condition is kept well.

[Second Embodiment]

Figure 7:
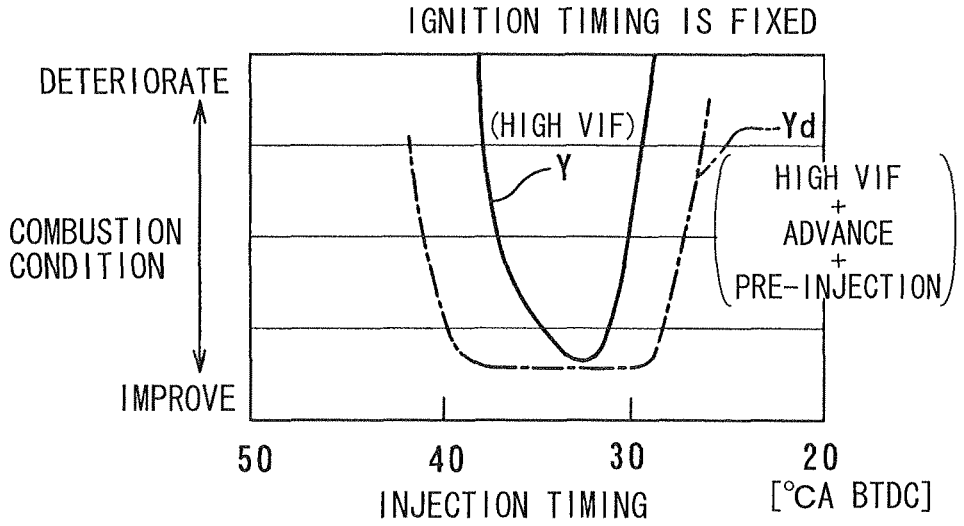
FIG. 7 is a graph showing a relationship between a fuel injection timing and a variation in combustion condition according to a second embodiment.

Referring to FIGS. 3 and 7, a second embodiment of the present invention will be described. In the successive embodiments, the same parts and components as those in the first embodiments are indicated with the same reference numerals.

Specifically, when it is determined that the computed VIF is higher than the viscosity of gasoline at normal temperature, the fuel injection start timing of the fuel injector 4 is advanced according to the VIF and a split injection is conducted before a main injection. That is, a pre-injection is conducted to vary a fuel injection control pattern.

Specifically, when the VIF is high, the fuel injection start timing is advanced as shown by a solid line "Edd" in FIG. 3 and a pre-injection signal "P" is generated before the main injection. Although FIG. 3 shows a single pre-injection, multiple pre-injection can be conducted.

(Advantage of Second Embodiment)

As described above, when it is determined that the computed VIF is higher than the viscosity of gasoline at normal temperature, the fuel injection start timing is advanced and the pre-injection is conducted before the main injection. By conducting the pre-injection, the fuel spray can be spread and the fuel spray having low penetrating force can be formed. The fuel spray is well formed at a vicinity of the discharge electrode 2*a* of the spark plug 2. Even if the VIF is high, the fuel injection start timing of the fuel injector 4 is advanced and the pre-injection is conducted, whereby the stable combustion range [° CA BTDC] is expanded as shown by a long dashed short dashed line "Yd" in FIG. 7, which is wider than the first embodiment.

[Third Embodiment]

Referring to FIGS. 8 to 11, a third embodiment of the present invention will be described.

According to a third and a fourth embodiment, when the VIF is high, an intensity of a vortex flow in a combustion chamber is increased in order to avoid a deterioration in combustion condition. That is, the intensity of the vortex flow is increased to vary the fuel injection control pattern.

Figure 8:
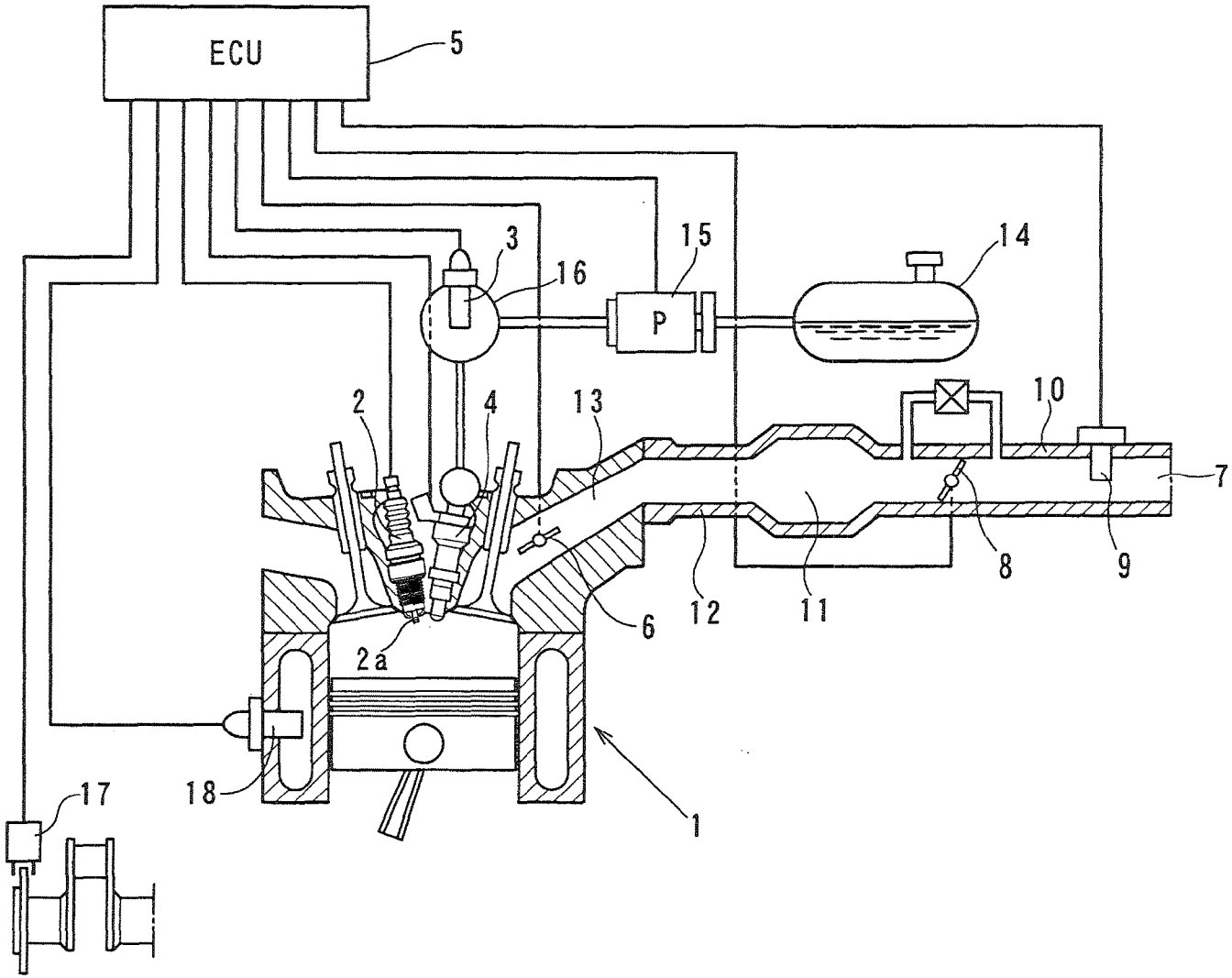
FIG. 8 is a schematic view showing a spark ignition internal combustion engine according to a third and a fourth embodiment.

As shown in FIG. 8, the engine 1 is equipped with a swirl flow controller having a swirl generating valve 6 and an actuator (not show) driving the swirl generating valve 6. The swirl flow controller generates a swirl flow in a cylinder of the engine 1 according to the engine driving condition, such as the engine speed, the engine load, the engine temperature, and the viscosity of the fuel.

The valve position of the swirl generating valve 6 may be continuously varied to generate the target swirl flow corresponding to the engine driving condition. Alternatively, the position of the swirl generating valve 6 may be stepwise varied.

The swirl generating valve 6 is arranged in the intake passage 7 to bias the intake airflow.

The swirl generating valve 6 is driven in a range between a full close position and a full open position. In the full close position, a gap clearance is slightly formed between the swirl generating valve 6 and an inner side wall of the intake passage 7. In the full open position, the swirl generating valve 6 fully opens the intake passage 7. As an opening degree of the swirl generating valve 6 is smaller, the intensity of the swirl flow is more increased. As the opening degree of the swirl generating valve 6 is larger, the intensity of the swirl flow is more decreased.

Figure 9A:
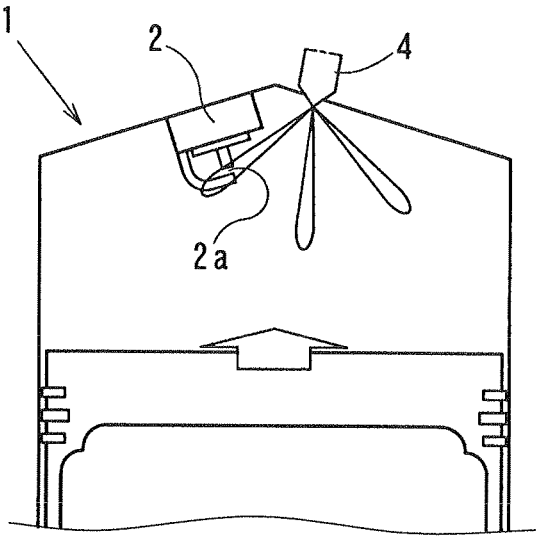
FIG. 9A is a schematic view showing a combustion chamber in which a swirl flow is generated when viewed perpendicularly relative to an axis of a position according to the third embodiment.
Figure 9B:
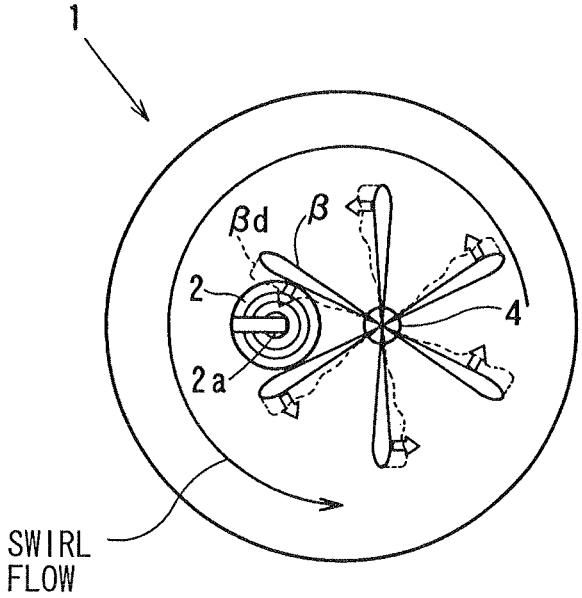
FIG. 9B is a schematic view showing a combustion chamber in which a swirl flow is generated when viewed from a top of a cylinder according to the third embodiment.

As shown in FIG. 9A, the fuel injector 4 is provided on an engine 1 in such a manner as to inject the fuel toward a vicinity of the discharge electrode 2*a* of the spark plug 2 in a case of spray-guided fuel injection. More specifically, as shown in FIG. 9B, the fuel injector 4 is provided in such a manner as to inject the fuel toward a vicinity of upstream of the swirl flow. A distance between the discharge electrode 2*a* and the fuel spray is designed optimum for a case of the stratified combustion of 100% gasoline weak swirl flow by the spray-guided fuel injection. Thus, in a case that the VIF is high, the fuel spray becomes narrower and the above distance is made longer, as shown by a solid line β in FIG. 9B. The stable combustion range is made narrower as shown by a solid line "Y" in FIG. 11.

In order to avoid the above situation, according to the third embodiment, the ECU 5 varies the intensity of the swirl flow by means of the swirl generating valve 6 according to the VIF. Specifically, when it is determined that the computed VIF is higher than the viscosity of gasoline at normal temperature, the ECU 5 drives the swirl generating valve 6 in a close direction to increase the intensity of the swirl flow. The increase amount of the swirl flow intensity relative to the VIF is obtained by means of a map or a formula previously stored in the ECU 5.

Figure 10:
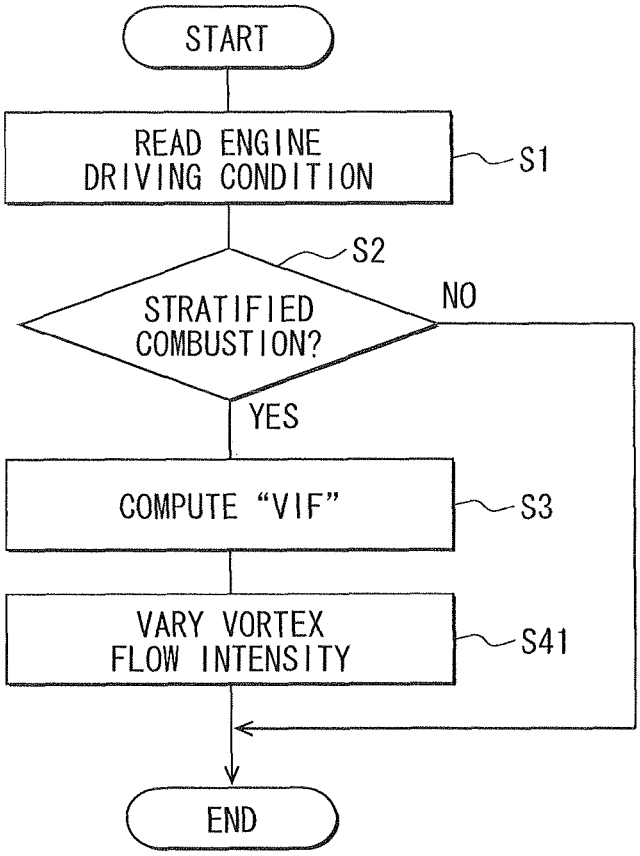
FIG. 10 is a flowchart showing a vortex intensity control according to the third and the fourth embodiment.

Referring to FIG. 10, a swirl flow intensity control which the ECU 5 executes according to the VIF will be described hereinafter.

In step S1, the ECU 5 reads an engine driving condition, such as the engine coolant temperature, the engine speed and the engine load.

In step S2, the ECU 5 determines whether a fuel combustion condition is the stratified combustion. When the answer is NO (homogeneous combustion) in step S2, the procedure ends.

When the answer is YES in step S2, the VIF is computed based on the output of the fuel pressure sensor 3. Then, the procedure proceeds to step S41 in which the swirl flow intensity is varied. Specifically, when it is determined that the computed VIF is higher than the viscosity of gasoline at normal temperature, the swirl flow intensity corresponding to the VIF is computed and the opening degree of the swirl generating valve 6 is adjusted to obtain the computed swirl flow intensity. Thereafter, the processing in FIG. 10 ends.

(Advantage of Third Embodiment)

Even if the fuel is injected in narrow shape due to the high VIF as shown by a solid line β in FIG. 9B, the swirl flow intensity is increased and the fuel spray comes close to the discharge electrode 2*a* as shown by a dashed line βd. The distance between the discharge electrode 2*a* and the fuel spray is made shorter, so that the air-fuel mixture is well formed at a vicinity of the discharge electrode 2*a*. That is, by the time when the spark plug 2 discharges, the fuel spray comes close to the discharge electrode 2*a* by increasing the swirl flow intensity so that combustion condition is kept well.

Figure 11:
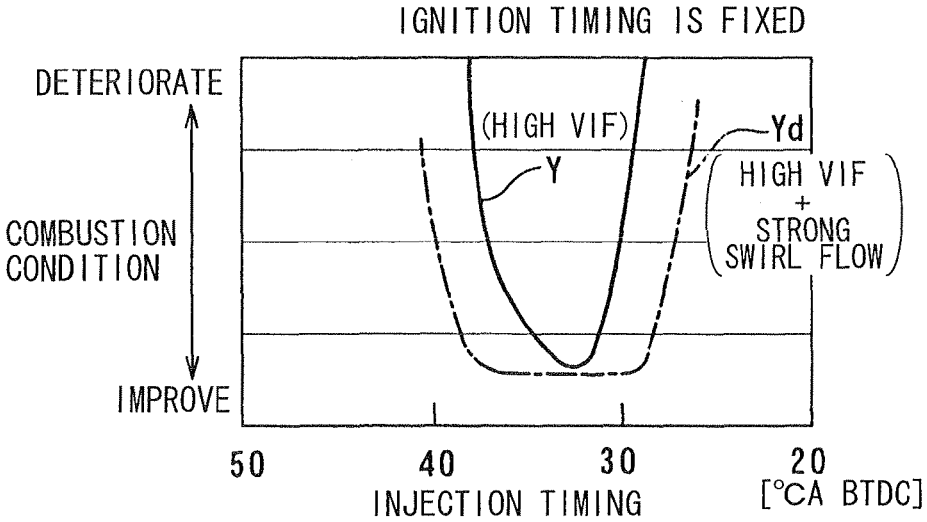
FIG. 11 is a graph showing a relationship between a fuel injection timing and a variation in combustion condition according to the third and the fourth embodiment.

According to a conventional art, if the VIF is high, the stable combustion range is narrow as shown by a solid line "Y" in FIG. 11. Meanwhile, in the third embodiment, even if the VIF is high, the swirl flow intensity is increased, whereby the stable combustion range is expanded as shown by a long dashed short dashed line "Yd" in FIG. 11.

[Fourth Embodiment]

Referring to FIG. 12, a fourth embodiment of the present invention will be described.

The engine 1 is equipped with a tumble flow controller having a tumble generating valve and an actuator driving the tumble generating valve. The tumble generating valve is arranged at the same position as the swirl valve 6 in the third embodiment. The tumble flow controller generates a tumble flow in a cylinder of the engine 1 according to the engine driving condition, such as the engine speed, the engine load, the engine temperature, and the viscosity of the fuel. The tumble generating valve of the fourth embodiment is denoted by a reference numeral "6" in FIG. 8, which is the same as the swirl generating valve in the third embodiment for an easy explanation.

The tumble generating valve 6 is driven in a range between a full close position and a full open position. In the full close position, a gap clearance is slightly formed between the tumble generating valve 6 and an inner upper side wall of the intake passage 7. In the full open position, the tumble generating valve 6 fully opens the intake passage 7. As an opening degree of the tumble generating valve 6 is smaller, the intensity of the tumble flow is more increased. As the opening degree of the tumble generating valve 6 is larger, the intensity of the tumble flow is more decreased.

Figure 12A:
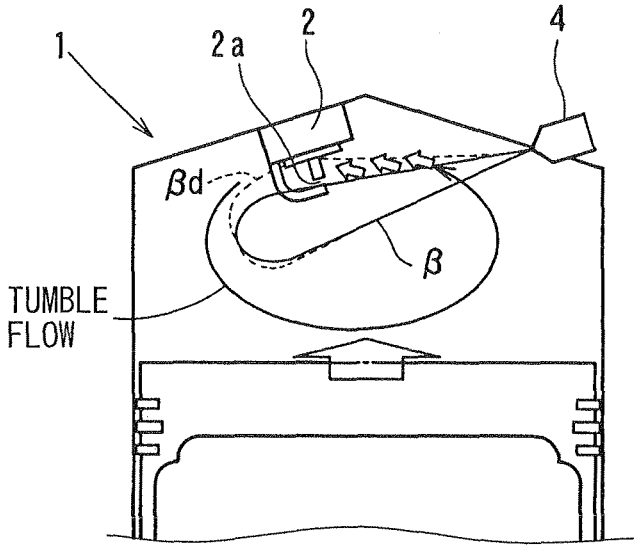
FIG. 12A is a schematic view showing a combustion chamber in which a tumble flow is generated when viewed perpendicularly relative to an axis of a piston according to the fourth embodiment.

As shown in FIG. 12A, the fuel injector 4 is provided on an engine 1 in such a manner as to inject the fuel toward a vicinity of the discharge electrode 2*a* of the spark plug 2 in a case of spray-guided fuel injection. More specifically, the fuel injector 4 is provided in such a manner as to inject the fuel toward a vicinity of upstream of the tumble flow. A distance between the discharge electrode 2*a* and the fuel spray is designed optimum for a case of the stratified combustion of 100% gasoline weak tumble flow by the spray-guided fuel injection.

Figure 12B:
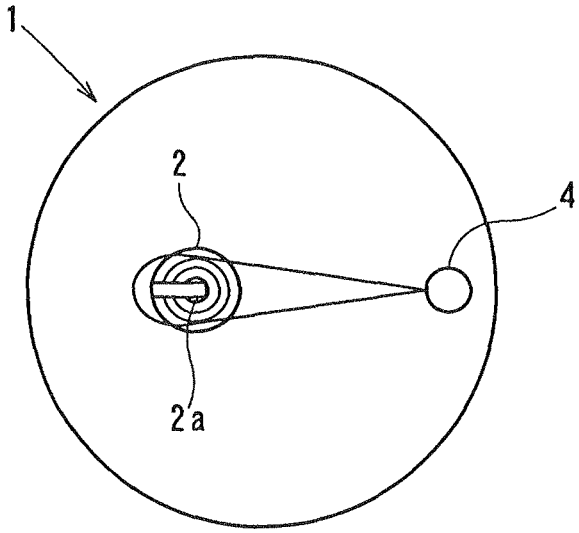
FIG. 12B is a schematic view showing a combustion chamber in which a tumble flow is generated when viewed from a top of a cylinder according to the fourth embodiment.

Thus, in a case that the VIF is high, the fuel spray becomes narrower and the above distance is made longer, as shown by a solid line β in FIG. 12B. The stable combustion range is made narrower as shown by a solid line "Y" in FIG. 11.

In order to avoid the above situation, according to the fourth embodiment, the ECU 5 varies the intensity of the tumble flow by means of the tumble generating valve 6 according to the VIF. Specifically, when it is determined that the computed VIF is higher than the viscosity of gasoline at normal temperature, the ECU 5 drives the tumble generating valve 6 in a close direction to increase the intensity of the tumble flow. The tumble generating valve 6 is controlled in the same manner as the swirl generating valve in the third embodiment.

(Advantage of Fourth Embodiment)

Even if the fuel is injected away from the discharge electrode 2*a* due to the high VIF as shown by a solid line β in FIG. 12A, the tumble flow intensity is increased and the fuel spray comes close to the discharge electrode 2*a* as shown by a dashed line βd. The distance between the discharge electrode 2*a* and the fuel spray is made shorter, so that the air-fuel mixture is well formed at a vicinity of the discharge electrode 2*a*. That is, by the time when the spark plug 2 discharges, the fuel spray comes close to the discharge electrode 2*a* by increasing the tumble flow intensity so that combustion condition is kept well and the stable combustion range can be expanded as shown in a long dashed short dashed line "Yd" in FIG. 11.

[Other Embodiment]

In the above second embodiment, when the VIF is high, the main fuel injection timing is advanced and a pre-injection is conducted. As other embodiment, the pre-injection may be conducted without advancing the main fuel injection timing.

The VIF can be computed based on a displacement rate of a needle valve of a fuel injector 4.

Since the viscosity of gasoline varies according to its temperature, the present invention can be applied to an engine which employs only gasoline as fuel.

Further, the present invention can be applied to an engine which performs the stratified combustion by wall-guided injection.

The first embodiment and the second embodiment can be combined, and the third embodiment and the fourth embodiment can be combined.

What is claimed is:

1. A spark ignition internal combustion engine in which a fuel starts to be combusted by a spark generated by a spark plug, the spark ignition internal combustion engine comprising:

a fuel viscosity detector which detects a viscosity of the fuel;

a fuel injector which injects the fuel into a cylinder of the spark ignition internal combustion engine; and a controller which varies at least one of a fuel injection timing and a fuel injection control pattern of the fuel injector according to the viscosity of the fuel detected by the fuel viscosity detector; wherein the fuel injector directly injects the fuel into the cylinder, and the controller varies at least one of the fuel injection timing and the fuel injection control pattern of the fuel injector according to the viscosity in a case that a stratified combustion is conducted.

2. A spark ignition internal combustion engine according to claim 1, wherein the controller advances the fuel injection timing of the fuel injector according to the detected viscosity of the fuel when it is determined that the detected viscosity of the fuel is higher than a viscosity of gasoline at normal temperature.

3. A spark ignition internal combustion engine according to claim 1, wherein the controller advances the fuel injection timing of the fuel injector and performs a split injection according to the detected viscosity of the fuel when it is determined that the detected viscosity of the fuel is higher than a viscosity of gasoline at normal temperature.

4. A spark ignition internal combustion engine in which a fuel starts to be combusted by a spark generated by a spark plug, the spark ignition internal combustion engine comprising:

a fuel viscosity detector which detects a viscosity of the fuel, a fuel injector which injects the fuel into a cylinder of the spark ignition internal combustion engine;

a vortex generating portion which generates a vortex flow in the cylinder; and a controller which controls the vortex generating portion in such a manner that an intensity of the vortex flow is varied according to the viscosity of the fuel detected by the fuel viscosity detector, wherein:

the intensity of the vortex flow is varied so as to be increased as the detected viscosity of the fuel becomes higher;

the fuel injector directly injects the fuel into the cylinder; and the controller controls the vortex generating portion in a case that a stratified combustion is conducted.

5. A spark ignition internal combustion engine according to claim 4, wherein the controller controls the vortex generating portion so that the intensity of the vortex flow is increased when it is determined that the detected viscosity of the fuel is higher than a viscosity of gasoline at normal temperature.

6. A spark ignition internal combustion engine according to claim 1, wherein the fuel viscosity detector detects the viscosity of the fuel based on a variation in fuel pressure due to an operation of the fuel injector.

7. A spark ignition internal combustion engine according to claim 1, wherein the fuel viscosity detector detects the viscosity of the fuel based on a displacement rate of a needle valve of the fuel injector.

* * * * *